US005805962A

United States Patent [19]

Ko

[11] Patent Number: 5,805,962

[45] Date of Patent: Sep. 8, 1998

[54] AUXILIARY CHARGING DEVICE OF ELECTROPHOTOGRAPHY PRINTING APPARATUS

[75] Inventor: Chang-Kyung Ko, Kyungki-do, Rep. of Korea

[73] Assignee: SamSung Electronics Co., Ltd., Kyungki-do, Rep. of Korea

[21] Appl. No.: 802,205

[22] Filed: Feb. 18, 1997

[30] Foreign Application Priority Data

Feb. 17, 1996 [KR] Rep. of Korea ..... 1996-2529

[51] Int. Cl.[6] ..... G03G 15/02

[52] U.S. Cl. ..... 399/174; 399/168; 399/176; 361/225

[58] Field of Search ..... 399/168, 169, 399/170, 174, 176; 361/225, 230

[56] References Cited

U.S. PATENT DOCUMENTS

| | | | |
|---|---|---|---|
| 5,126,913 | 6/1992 | Araya et al. | 361/225 |
| 5,164,779 | 11/1992 | Araya et al. . | |
| 5,247,328 | 9/1993 | Daunton et al. . | |
| 5,479,243 | 12/1995 | Kurokawa et al. . | |
| 5,512,982 | 4/1996 | Takahashi et al. | 399/176 |
| 5,517,289 | 5/1996 | Ito et al. . | |
| 5,535,088 | 7/1996 | Sato et al. | 361/225 |
| 5,557,375 | 9/1996 | Nagayasu . | |
| 5,568,232 | 10/1996 | Kashihara . | |
| 5,585,894 | 12/1996 | Araya et al. | 399/176 X |
| 5,715,499 | 2/1998 | Yamazaki et al. | 399/174 X |

FOREIGN PATENT DOCUMENTS 61-198253 9/1986 Japan .

*Primary Examiner*—Matthew S. Smith
*Attorney, Agent, or Firm*—Robert E. Bushnell, Esq.

[57] ABSTRACT

A charging device of an electrophotography printing apparatus may improved the charging efficiency by preventing the potential difference generated at both ends of a photosensitive drum. An auxiliary charging device includes an auxiliary charging plate to which voltage is applied. The plate is installed to come into contact with both ends of the photosensitive drum in order to compensate for a potential level in a developing cartridge. The electrophotography printing apparatus may include a charging unit, a developing unit and a toner supplying unit provided around the photosensitive drum.

20 Claims, 4 Drawing Sheets

AUXILIARY CHARGING DEVICE OF ELECTROPHOTOGRAPHY PRINTING APPARATUS

CLAIM OF PRIORITY

This application makes reference to, incorporates the same herein, and claims all benefits accruing under 35 U.S.C §119 from an application entitled *Auxiliary Charging Device of Electrophotography Printing Apparatus* earlier filed in the Korean Industrial Property Office on the 17th of Feb. 1996, and there duly assigned Ser. No. 2529/1996 by that Office.

BACKGROUND OF THE INVENTION

1. Field of the Invention

The present invention relates to an auxiliary charging device of an electrophotography printing apparatus. More particularly, the present invention relates to an auxiliary charging device for compensating for the deterioration of charging efficiency resulting from the degradation of a photosensitive drum.

2 . Discussion of Related Art

An electrophotography printing apparatus such as a copy machine or a printer produces electrostatic latent images on a photosensitive drum by converting digital signals corresponding to image data generated from a computer or a copy of an original document into light signals. The signals are sent through an exposure device, and then printed by fixing a toner on paper. A developing cartridge of the electrophotography printing apparatus is an assembly of charging, exposing, developing, and transferring mechanisms that exposes image data on the photosensitive drum, supplies toner to the exposed portion, and transfers toner images to print media.

Generally, as a unit for charging the surface of the photosensitive drum, a contact-type charging roller as disclosed, for example, in U.S. Pat. No. 5,164,779 for *Image Forming Apparatus With Dual Voltage Supplies For Selectively Charging And Discharging An Image Bearing Member* issued to Araya et al., U.S. Pat. No. 5,247,328 for *Method And Apparatus For Charging A Photoconductive Surface To A Uniform Potential* issued to Daunton et al., U.S. Pat. No. 5,479,243 for *Image Forming Apparatus And Charging Device Thereof* issued to Kurokawa, U.S. Pat. No. 5,517,289 for *Apparatus for And Method Of Forming Image* issued to Ito et al., U.S. Pat. No. 5,557,375 for *Contact Type Charging Device And Image Forming Apparatus Having The Same* issued to Nagayasu et al., and U.S. Pat. No. 5,568,232 for *Image Forming Apparatus Capable Of Removing Toner Fragments And Shavings From A Contact Charging Device By Supplying A Voltage To An Image Carrier To Which The Fragments And Shavings Are Attracted* issued to Kashihara, using a so-called contact (or direct) charging scheme or a corona wire using a corona discharging scheme may be used to produce an uniform electric field in response to application of high voltage for charging the surface of the photosensitive drum to a constant potential to attract toner particles and thereby form the latent image on the photosensitive drum. Typically, a charging unit is charged at the start of a printing operation. The surface of the photosensitive drum is charged and a developing unit is concurrently charged by way of the charging unit as the photosensitive drum rotates in a direction opposite to the rotation of the developing unit. As a result, an electrostatic latent image is formed on the photosensitive drum and the latent image is then visualized as a toner image by the developing unit. The charged area of the photosensitive drum is then exposed to a laser beam. Because of the potential difference between the exposed area and the unexposed area of the photosensitive drum, the toner particles are attracted only to the exposed area to form the toner image on the photosensitive drum. The toner image is then transferred to the recording medium. After the toner image is transferred to the recording medium, the photosensitive drum is charged back to an original voltage as the recording medium is being conveyed to a fixing unit. A common problem in contemporary charging units, as I have observed, is that toner supplied from the developing unit often sticks on an unexposed area of the photosensitive drum in the vicinity of the edges of the recording medium, so that contamination occurs.

From my study of these exemplars of the contemporary practice and the art, I find that there is a need for and improved and effective auxiliary charging device for compensating for the deterioration of charging efficiency resulting from the degradation of a photosensitive drum.

SUMMARY OF THE INVENTION

Accordingly, an object of the present invention is to provide an improved auxiliary charging device of an electrophotography printing apparatus.

Another object of the present invention is to provide an improved auxiliary charging device for compensating for the deterioration of charging efficiency resulting from the degradation of a photosensitive drum.

A further object of the present invention is to provide an improved auxiliary charging device for compensating for the deterioration of charging efficiency resulting from the degradation of a photosensitive drum caused by the contamination of both ends thereof.

Another object of the present invention is to compensate for the degradation of charging characteristic resulting from the contamination of the surface of the photosensitive drum by applying an auxiliary voltage to both ends of the photosensitive drum between a transferring unit and a charging unit.

To achieve these or other objects, an auxiliary charging device includes an auxiliary charging plate to which a voltage is applied, the plate being installed to come into contact with both ends of the photosensitive drum in order to compensate for a potential level, in a developing cartridge of an electrophotography printing apparatus comprising a charging unit, a developing unit and a toner supplying unit provided around the photosensitive drum.

Another developing cartridge of an electrophotography printing apparatus includes a charging unit. A developing unit and a toner supplying unit is provided around a photosensitive drum. An auxiliary charging device includes an auxiliary charging plate to which a voltage is applied. The plate is installed to come into contact with both ends of the drum in order to compensate for a potential level. The auxiliary charging plate can be in the form of auxiliary charging roller in order to compensate for the potential level at both ends of the photosensitive drum.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Reference will now be made in detail to the preferred embodiments of the present invention, examples of which are illustrated in the accompanying drawings.

Figure 1:
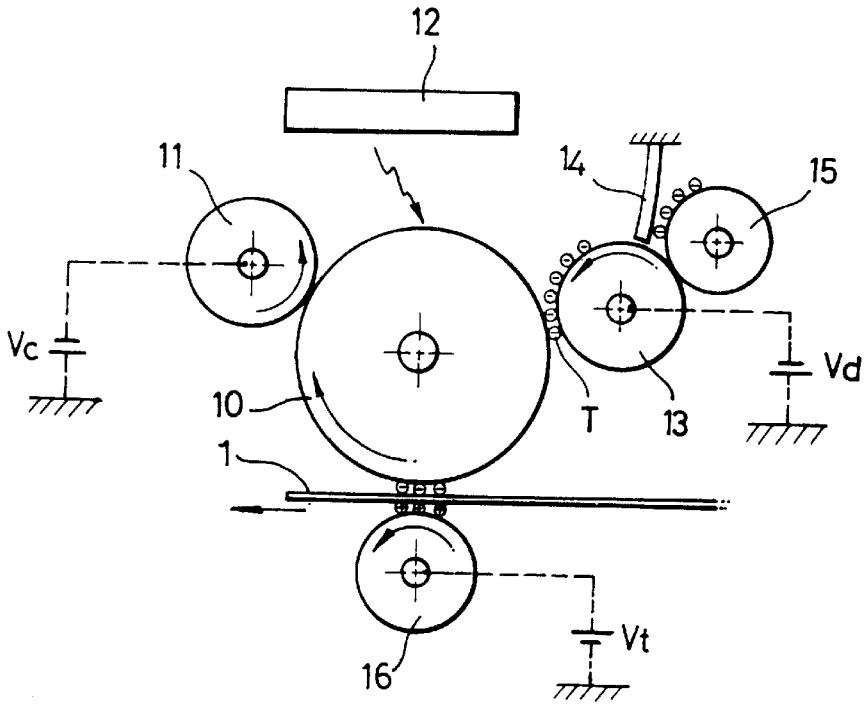
FIG. 1 illustrates the structure of an electrophotography printing apparatus.

Turning now to the drawings, FIG. 1 depicts the developing cartridge of a contemporary electrophotography printing apparatus. A charging roller 11, to which voltage Vc is applied, uniformly charges the surface of a photosensitive drum 10 at a high voltage, rotating together with it. An electrostatic latent image is generated on the charged portion of the photosensitive drum 10 through a laser beam projected by an exposure device 12. The exposure device 12 converts image data into laser beams, and then projects them. The quantity of toner T supplied by a toner supplying roller 15 is controlled by a blade 14, and is supplied to a developing roller 13.

The developing roller 13 is applied with voltage, and sends back the toner T through a carrier so that the toner T sticks on the portion of the electrostatic latent image generated on the photosensitive drum 10. The photosensitive drum 10 having an electrostatic latent image on which the toner T sticks, rotates uniformly so that the toner T sticks to a print media 1 for printing image data corresponding to the electrostatic latent image. A transferring roller 16 to which a high voltage Vt is applied, makes a positive polarity on the surface thereof and fixes the toner T stuck by the electrostatic latent image of the photosensitive drum 10 to the print media 1 in order to make an image corresponding to image data.

Figure 2:
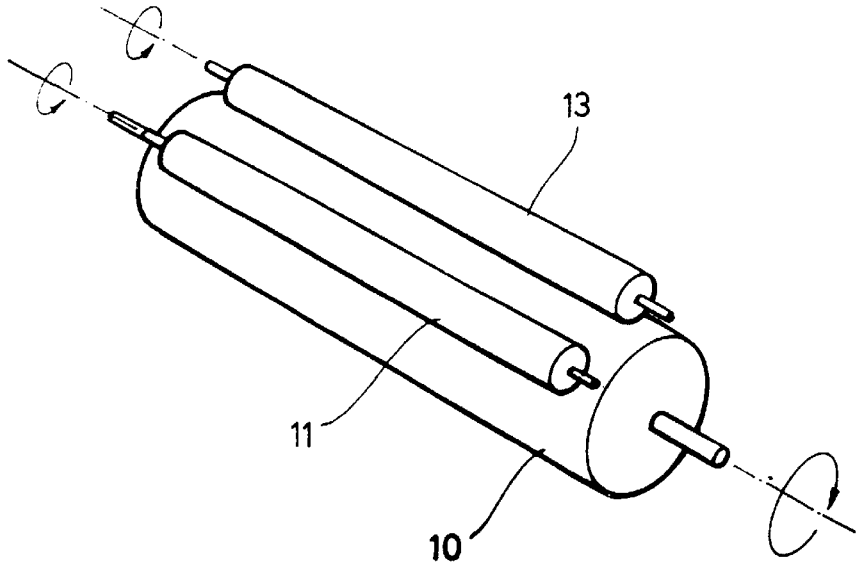
FIG. 2 depicts the cartridge of a contemporary electrophotography printing apparatus.

Printing image characteristics and developing cartridge characteristics vary in accordance with size, location, sealing state of the respective rollers. A developing cartridge may include a photosensitive drum 10, a charging roller 11, an exposure portion 12 (shown in FIG. 1), and a developing roller 13, as illustrated in FIG. 2. Especially in case that the surface of the photosensitive drum 10 is contaminated, the charging efficiency of the charging roller 11 is deteriorated when an electric charge is applied on the surface of the photosensitive drum 10. For example, −650V is a normal surface potential of the photosensitive drum 10; −300V is normal in case of characteristics degradation resuling from contamination; and −100V is normal in case of worse condition. Here, there is no potential difference between the exposed portion by the exposure portion 12 and the non-exposed portion in the photosensitive drum 10 so that the toner T sticks on the non-exposed portion.

Figure 3:
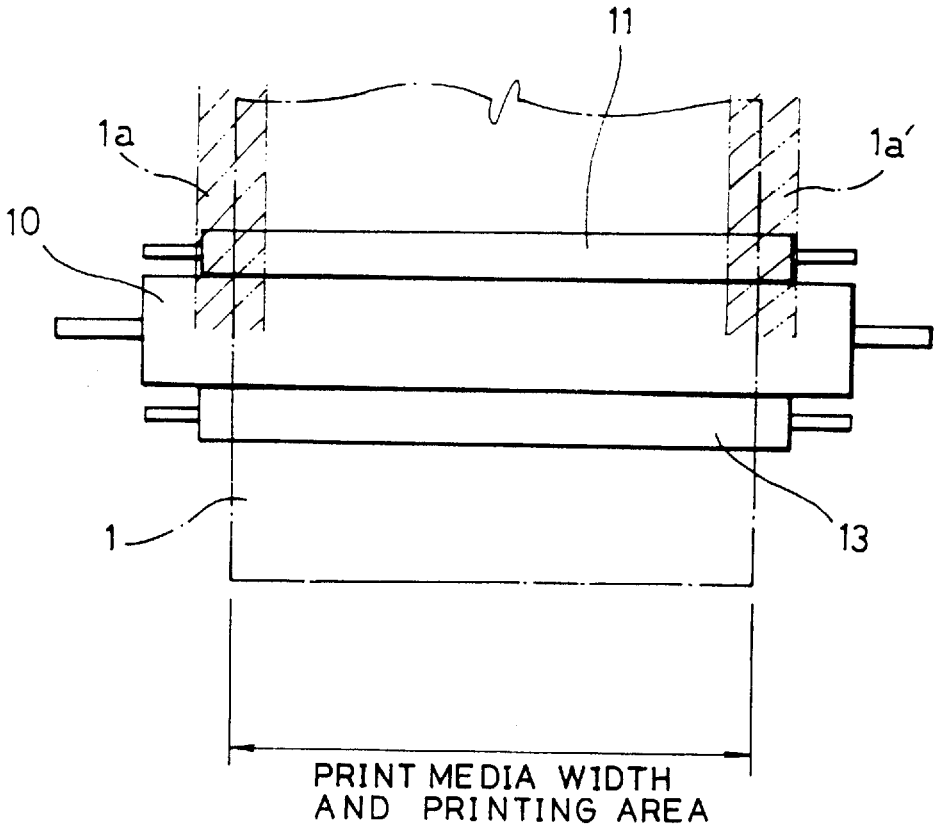
FIG. 3 shows the media printed by the developing cartridge of FIG. 2.

This status will be described in detail with reference to FIG. 3. In case that contamination occurs due to the toner which is supplied from the developing roller 13, and then remains on the surface of the photosensitive drum 10, the surface potential generated by the charging roller 11 decreases rapidly at both ends of the photosensitive drum 10, as shown in FIG. 3. When the surface potential of both ends decreases rapidly, there is no potential difference between electrostatic latent image-forming portion by being exposed by means of a laser beam projected from the exposure portion 12 (shown in FIG. 1) and the non-exposed portion in the surface potential formed on both ends of the photosensitive drum 10. Accordingly, there is a problem that the toner supplied from the developing roller 13 also sticks on an area other than print image area so that both edges of the print media la and la' are contaminated due to the toner.

Figure 4:
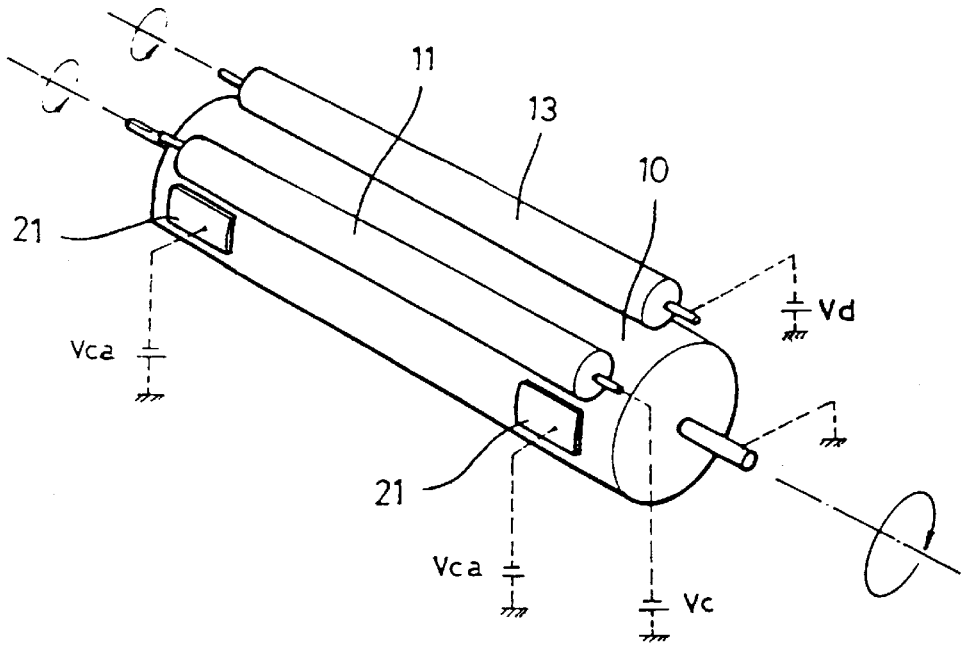
FIG. 4 depicts the structure of a preferred embodiment of a charging device of an electrophotography printing apparatus of the present invention.

FIG. 4 is a structure of a charging device of an electrophotography printing apparatus according to the present invention. As illustrated in FIG. 4, an auxiliary charging plate 21 has a uniform thickness, and is contacted with both ends of a photosensitive drum 10, and direct current Vca of a high voltage is applied to the plate 21. After receiving direct current Vca applied, the auxiliary charging plate 21 generates an auxiliary potential difference on the surface of the photosensitive drum 10. Direct current Vca of a high voltage applied through the auxiliary charging plate 21 is equal to or slightly lower than charging voltage Vc applied through a charging roller 11.

Figure 5:
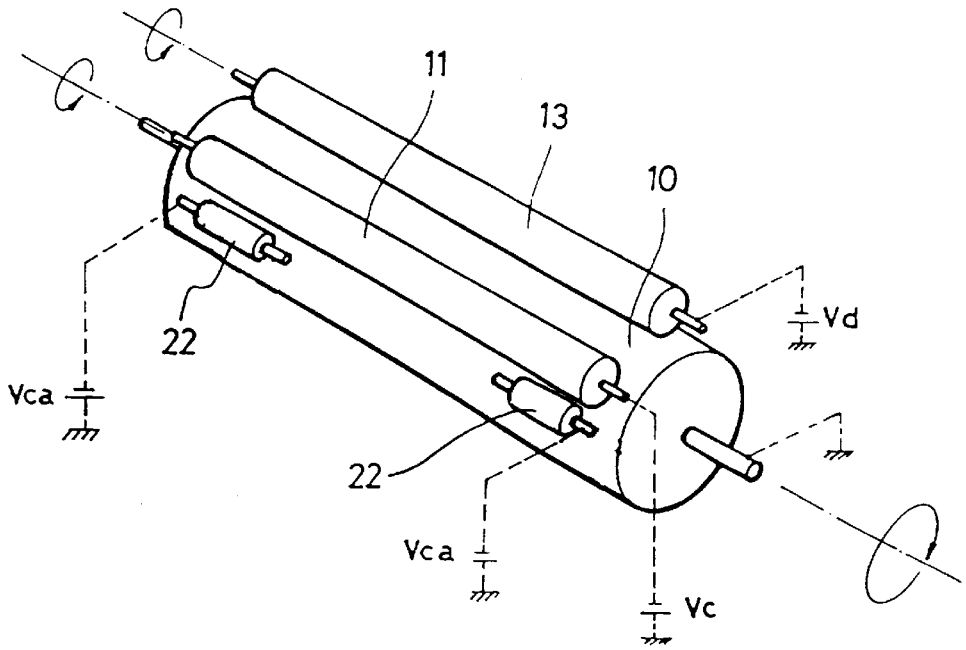
FIG. 5 depicts the structure of another embodiment of a charging device of an electrophotography printing apparatus according to the present invention.

Such auxiliary charging plate 21 compensates for the potential difference abruptly decreasing at both ends of the surface of the photosensitive drum 10 due to contamination of residue toner. FIG. 5 depicts another preferred embodiment of the auxiliary charging plate 21. An auxiliary charging roller 22 is contacted with both ends of the photosensitive drum 10, and direct current Vca of a high voltage is applied to the roller 22. Direct current Vca of a high voltage applied through the auxiliary charging roller 22 is equal to or slightly lower than charging voltage Vc applied through the charging roller 11. Like the auxiliary charging plate 21, such an auxiliary charging roller 22 compensates for the potential difference sharply decreasing at the surface of both ends of the photosensitive drum 10 due to its contamination.

Figure 6:
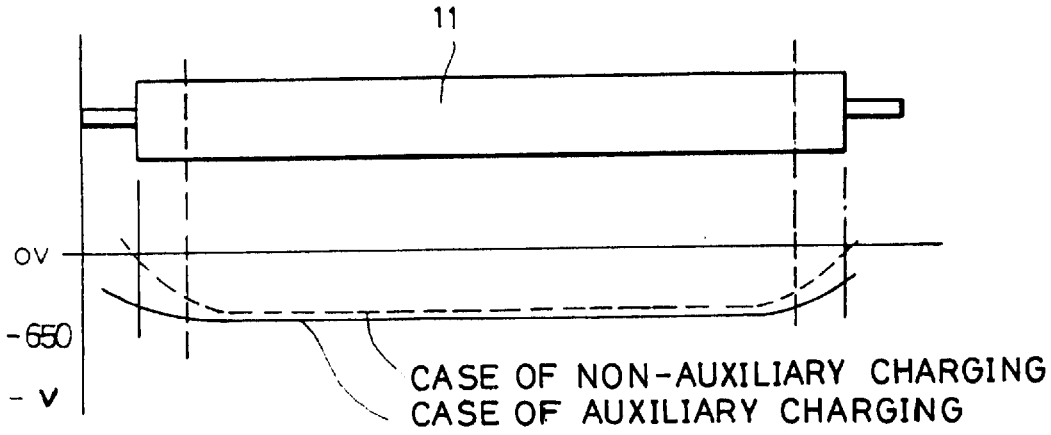
FIG. 6 illustrates a potential difference of a charging unit of an electrophotography printing apparatus of the present invention.

FIG. 6 shows the charge potential difference of the photosensitive drum 10 resulting from the use of the auxiliary charging plate 21 or the auxiliary charging roller 22. The surface potential (a dotted line) decreased abruptly at both ends of the photosensitive drum 10 due to contamination of the residue toner formed on the surface of the drum 10 is compensated for with the potential level shown as a solid line by means of an auxiliary charging voltage Vca applied through the auxiliary charging plate 21 or the auxiliary charging roller 22. Such an auxiliary charging plate 21 or auxiliary charging roller 22 can prevent deterioration of the print quality which occurs at both edges of the print media and improve the print surface quality, by compensating for the decrease of potential difference resulting from the contamination of the surface of the photosensitive drum 10. The improvement of print surface quality is attained when uniform charge is generated on both ends and center of the surface of the photosensitive drum 10 by applying an auxiliary charging voltage on the surface of the photosensitive drum 10.

It will be apparent to those skilled in the art that various modifications and variations can be made in an auxiliary charging device of an electrophotography printing apparatus of the present invention without departing from the spirit or scope of the invention. Thus, it is intended that the present invention cover the modifications and variations of this invention provided they come within the scope of the appended claims and their equivalents.

What is claimed is:

1. An image forming apparatus, comprising:

a photosensitive drum;

a main charging unit extending in a lengthwise direction of the photosensitive drum, for applying a predetermined charging voltage to uniformly charge a surface of said photosensitive drum during a charging operation;

a first auxiliary charging device separated and spaced-apart from the main charging unit, and positioned to make contact with a first end of said photosensitive drum, for applying a predetermined auxiliary charging voltage exhibiting a voltage level substantially the same as said predetermined charging voltage to charge the first end of said photosensitive drum during said charging operation; and a second auxiliary charging device separated and spaced-apart from the main charging unit, and positioned to make contact with a second end of said photosensitive drum, for applying said predetermined auxiliary charging voltage to charge the second end of said photosensitive drum during said charging operation.

2. The image forming apparatus of claim 1, further comprised of said first and said second auxiliary charging devices each corresponding to a charging plate concomitantly charging the surface of opposite ends of the photosensitive drum from said predetermined auxiliary charging voltage.

3. The image forming apparatus of claim 2, further comprised of said first and said second charging device each exhibiting a uniform thickness for concomitantly applying said predetermined auxiliary charging voltage uniformly to the surface of opposite ends of said photosensitive drum during said charging operation to compensate for a potential drop at the opposite ends of said photosensitive drum due to contamination of residue toner deposited thereon.

4. The image forming apparatus of claim 1, further comprised of said first and said second auxiliary charging devices each corresponding to a contact-type charging roller concomitantly charging the surface of opposite ends of the photosensitive drum with said predetermined auxiliary charging voltage.

5. The image forming apparatus of claim 1, further comprised of said first and said second auxiliary charging device charging opposite ends of said photosensitive drum with said predetermined auxiliary charging voltage to compensate for a potential drop at the opposite ends of said photosensitive drum due to contamination of residue toner deposited thereon.

6. The image forming apparatus of claim 1, further comprised of said first and said second charging device each corresponding to a cylindrical contact-type roller for applying said predetermined auxiliary charging voltage to the surface of opposite ends of said photosensitive drum during said charging operation to compensate for a potential drop at the opposite ends of said photosensitive drum due to contamination of residue toner deposited thereon.

7. The image forming apparatus of claim 6, further comprised of said predetermined auxiliary charging voltage being set at said voltage level that is independent from said predetermined charging voltage.

8. The image forming apparatus of claim 1, further comprised of said predetermined auxiliary charging voltage being set at said voltage level that is independent from said predetermined charging voltage.

9. An image forming apparatus, comprising:

a photosensitive drum a main contact-type charging roller positioned to contact with the photosensitive drum, for applying a predetermined charging voltage to uniformly charge a surface of said photosensitive drum during a charging operation;

a light exposing unit for exposing the surface of the photosensitive drum charged by said contact-type charging roller to form a latent image on said photosensitive drum;

a developing unit for developing the latent image electrostatically formed on said photosensitive drum to form a toner image on said photosensitive drum;

a transfer unit for transferring the toner image formed on said photosensitive drum to a recording medium;

a first auxiliary charging device separated and spaced-apart from the contact-type charging roller, and positioned to make contact with a first end of said photosensitive drum, for applying a predetermined auxiliary charging voltage exhibiting a voltage level substantially the same as said predetermined charging voltage to charge the surface of the first end of said photosensitive drum during said charging operation; and a second auxiliary charging device separated and spaced-apart from the contact-type charging roller, and positioned to make contact with a second end of said photosensitive drum, for applying said predetermined auxiliary charging voltage to charge the surface of the second end of said photosensitive drum during said charging operation.

10. The image forming apparatus of claim 9, further comprised of said first and said second auxiliary charging device each corresponding to a contact-type charging plate for concomitantly charging the surface of opposite ends of said photosensitive drum with said predetermined auxiliary charging voltage during said charging operation.

11. The image forming apparatus of claim 10, further comprised of said first and said second auxiliary charging device each exhibiting a uniform thickness for concomitantly applying said predetermined auxiliary charging voltage uniformly to the surface of the opposite ends of said photosensitive drum during said charging operation.

12. The image forming apparatus of claim 11, further comprised of said predetermined auxiliary charging voltage being set at said voltage level that is independent from said predetermined charging voltage.

13. The image forming apparatus of claim 9, further comprised of said first and said second auxiliary charging device each corresponding to a contact-type charging roller for concomitantly charging the surface of opposite ends of said photosensitive drum with said predetermined auxiliary charging voltage during said charging operation.

14. The image forming apparatus of claim 9, further comprised of said first and said second auxiliary charging device charging opposite ends of said photosensitive drum with said predetermined auxiliary charging voltage while said main contact-type charging roller charges the surface of said photosensitive drum with said predetermined charging voltage to compensate for a potential drop at the opposite ends of said photosensitive drum due to contamination of residue toner deposited thereon.

15. The image forming apparatus of claim 14, further comprised of said first and said second charging device each corresponding to a cylindrical contact-type roller for charging the surface of said opposite ends of said photosensitive drum with said predetermined auxiliary charging voltage during said charging operation to compensate for a potential drop at the opposite ends of said photosensitive drum due to toner contamination.

16. The image forming apparatus of claim 15, further comprised of said predetermined auxiliary charging voltage being set at said voltage level that is independent from said predetermined charging voltage.

17. A cartridge disposed adjacent to a photosensitive drum in an electrophotographic printing apparatus, comprising:

a main charging roller extending in a lengthwise direction of said photosensitive drum, for charging a surface of said photosensitive drum with a main charging voltage during a charging operation;

a toner supply unit for supplying toner;

a developing roller for applying the toner from said toner supply unit to said photosensitive drum for image development after said photosensitive drum is charged by said main charging roller;

a first auxiliary charging device separated and spaced-apart from said main charging roller, and positioned in contact with said photosensitive drum at a first end of said main charging roller, for charging a surface of the first end of said photosensitive drum with an auxiliary charging voltage set independently from said main charging voltage during said charging operation; and a second auxiliary charging device separated and spaced-apart from said main charging roller, and positioned in contact with said photosensitive drum at a second, and opposite end of said main charging roller, for charging a surface of the second, and opposite end of said photosensitive drum with said auxiliary charging voltage during said charging operation.

18. The cartridge of claim 17, further comprised of said first and said second auxiliary charging device each corresponding to a contact-type charging plate for concomitantly charging the surface of said photosensitive drum at opposite ends of said main charging roller with said auxiliary charging voltage during said charging operation.

19. The cartridge of claim 17, further comprised of said first and said second auxiliary charging device each corresponding to a contact-type charging roller for concomitantly charging the surface of said photosensitive drum at opposite ends of said main charging roller with said auxiliary charging voltage during said charging operation.

20. The cartridge of claim 17, further comprised of said first and said second auxiliary charging device charging the surface of said photosensitive drum at opposite ends of said main charging roller with said auxiliary charging voltage during said charging operation while said main contact-type charging roller charges the entire surface of said photosensitive drum with said main charging voltage to compensate for a potential drop of said photosensitive drum at the opposite ends of said main charging roller due to contamination of residue toner deposited thereon.

* * * * *